US008801391B2

(12) United States Patent
Kigure

(10) Patent No.: US 8,801,391 B2
(45) Date of Patent: Aug. 12, 2014

(54) APPARATUS FOR CONTROLLING ELECTRIC OIL PUMP

(75) Inventor: Masayuki Kigure, Isesaki (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 279 days.

(21) Appl. No.: 13/310,009

(22) Filed: Dec. 2, 2011

(65) Prior Publication Data

US 2012/0244012 A1 Sep. 27, 2012

(30) Foreign Application Priority Data

Mar. 22, 2011 (JP) ..... 2011-062062

(51) Int. Cl.
*F04B 49/06* (2006.01)

(52) U.S. Cl.
USPC ..... 417/44.11

(58) Field of Classification Search
CPC ..... F04B 2201/1201; F04B 2201/1203; F04B 2203/0208
USPC ..... 417/32, 42, 44.1, 44.11, 53
See application file for complete search history.

(56) References Cited

FOREIGN PATENT DOCUMENTS

JP 2009-299665 A 12/2009

*Primary Examiner* — Bryan Lettman
(74) *Attorney, Agent, or Firm* — Crowell & Moring LLP

(57) ABSTRACT

An apparatus for controlling an electric oil pump that can determine the occurrence of idling even in a region in which determination based on a load of the electric oil pump becomes difficult.

The apparatus for controlling an electric oil pump according to one embodiment of the invention sets a target number of revolutions for determination tNset higher than a required number of revolutions tNreq corresponding to an operation request of the electric oil pump, and executes control of an electric motor so that the number of revolutions N of the electric oil pump approaches the target number of revolutions for determination tNset. A load (phase current Ii) of the electric oil pump is detected while executing the control of the electric motor, and the occurrence of idling in the electric oil pump is determined based on a detected pump load (Inrm, IidI).

18 Claims, 11 Drawing Sheets

APPARATUS FOR CONTROLLING ELECTRIC OIL PUMP

BACKGROUND OF THE INVENTION

1. Field of the Invention

The present invention relates to an apparatus for controlling an electric oil pump that uses an electric motor as a power source.

2. Description of Related Art

As a method of determining idling of an electric oil pump, there is one that uses motor current during operation of the pump. Japanese Laid-open Patent Publication No. 2009-299665 discloses that motor current (for example, a drive command value thereof) during operation of the pump is detected and, when this value is smaller than a predetermined value, occurrence of idling is determined.

SUMMARY OF THE INVENTION

However, in an electric oil pump used in a situation in which pump resistance is to be small such as where hydraulic piping is open to the atmosphere, or the purpose of which is lubrication or cooling, pump resistance further decreases due to a decrease in oil viscosity with an increase in temperature, so that a difference in pump load (motor current) between a normal state time and a time when idling occurs decreases, thereby making it difficult to determine whether the decrease in the load is due to idling or due to the decrease in oil viscosity.

It is an object of the present invention to enable easy determination of the occurrence of idling, even in an area in which determination based on the load of the electric oil pump becomes difficult.

In one aspect, the present invention achieves the object by intentionally increasing the number of revolutions of the electric oil pump in order to determine the occurrence of idling. An apparatus for controlling an electric oil pump according to one aspect of the present invention is an apparatus for controlling an electric oil pump that supplies oil, using an electric motor as a power source. The apparatus sets a target number of revolutions for determination higher than a required number of revolutions corresponding to an operation request of the electric oil pump, and executes control of the electric motor for making the number of revolutions of the electric oil pump close to the set target number of revolutions for determination. Moreover, the apparatus detects a load of the electric oil pump while executing the control of the electric motor as a pump load, determines the occurrence of idling in the electric oil pump based on the detected pump load, and outputs a control signal corresponding to the determination result.

The other objects and features of this invention will be understood from the following description with reference to the accompanying drawings.

DESCRIPTION OF THE PREFERRED EMBODIMENTS

Figure 1:
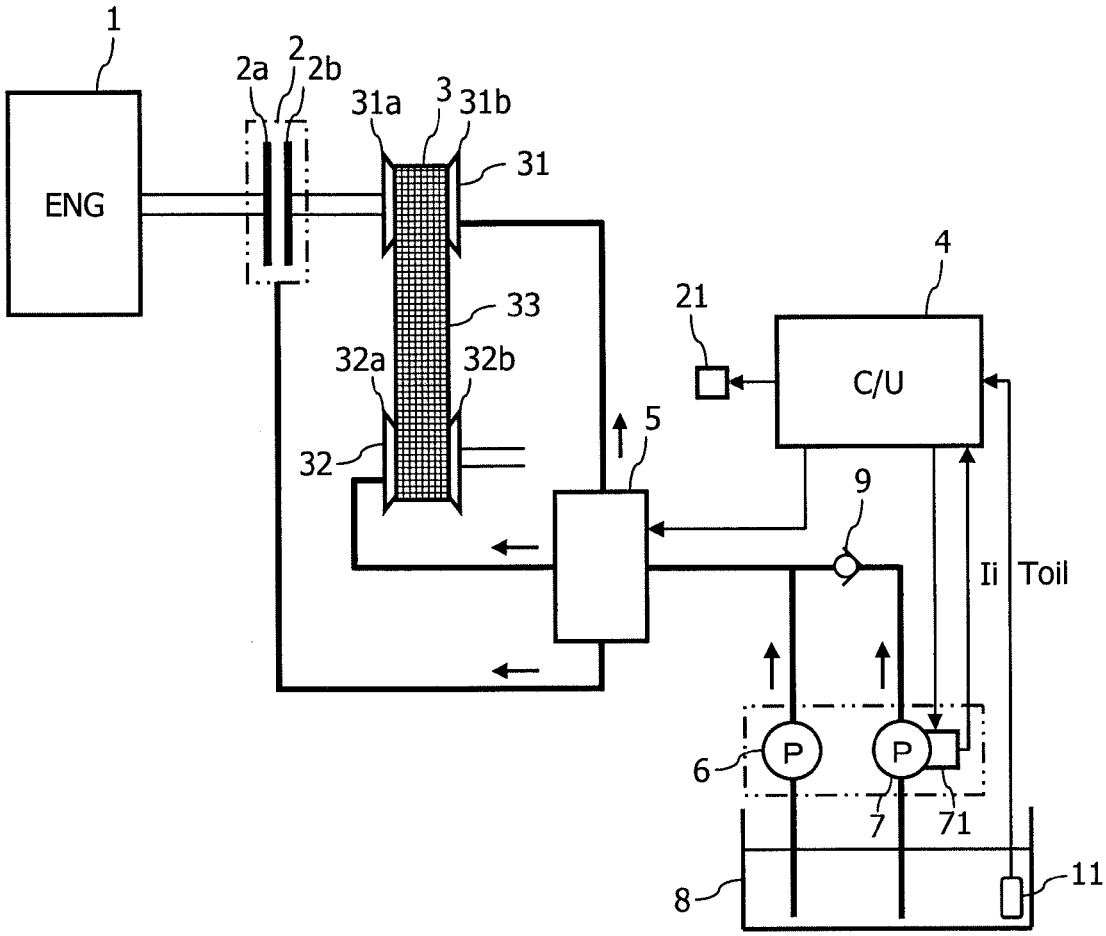
FIG. 1 is a configuration diagram of a vehicle transmission system including an apparatus for controlling an electric oil pump according to one embodiment of the present invention.

FIG. 1 is a configuration diagram of a vehicle transmission system including an apparatus 4 for controlling an electric oil pump 7 according to one embodiment of the present invention.

In the present embodiment, an internal combustion engine (hereinafter, referred to as an "engine") 1 constitutes a power source of a self-propelled vehicle. A crankshaft is connected to a continuously variable transmission 3 via a start clutch 2 and a forward and backward switching mechanism (not shown) for switching over forward movement and backward movement of the vehicle.

Start clutch 2 is a wet multiplate clutch (FIG. 1 shows only a pair of clutch plates for illustration purposes) in the present embodiment, in which clutch plates 2*a* and 2*b* on input and output sides are coupled upon supply of oil at the time of starting the vehicle, to transmit an output torque of engine 1 to continuously variable transmission 3.

Continuously variable transmission 3 includes a primary pulley 31, a secondary pulley 32, and a belt 33 spanned between these pulleys 31 and 32. Engine torque received by primary pulley 31 is transmitted to secondary pulley 32 via belt 33 to rotate a shaft member connected to drive wheels of the vehicle. A transmission gear ratio of continuously variable transmission 3 can be changed by adjusting supply pressure of oil to pulleys 31 and 32. Specifically, a radius at a belt contact position in each of pulleys 31 and 32 is adjusted by axially shifting movable conical plates 31*a*, 31*b* and 32*a*, 32*b* facing each other in each of pulleys 31 and 32 by supply of oil, thereby changing a rotation speed ratio of pulleys 31 and 32.

A control unit 4 constitutes the "apparatus for controlling an electric oil pump" in the present embodiment, and realizes functions of a "determination time control section", a "pump operation state detecting section", an "idling determining section", and a "control signal output section". Control unit 4 has a microcomputer incorporated therein, and receives inputs of various sensor output signals indicating an operating condition of the vehicle, and calculates a start and transmission control signal based on these sensor output signals, and outputs the calculated control signal to a pressure-regulating device 5.

Pressure-regulating device 5 receives input of the start and transmission control signal, adjusts the discharge pressure of oil pumps 6 and 7 to a target supply pressure for each section of the transmission system, based on the control signal, and supplies pressure-regulated oil to start clutch 2 and continuously variable transmission 3.

The oil pump system according to the present embodiment is configured by combining a mechanical drive pump (mechanical oil pump) 6 that operates upon reception of an output torque of engine 1, and an electrical drive pump (electric oil pump) 7 having an electric power source. Electric oil pump 7 is installed in an oil passage that bypasses mechanical oil pump 6, and uses an electric motor (in the present embodiment, brushless motor) 71 as a power source. Mechanical oil pump 6 and electric oil pump 7 can operate simultaneously or individually, and draw up oil from an oil pan 8 fitted to a transmission housing (not shown), and supply oil to pressure-regulating device 5. In the present embodiment, a check valve 9 is installed in the oil passage where electric oil pump 7 is provided. Check valve 9 prevents high-pressure oil drawn up by mechanical oil pump 6 from flowing back into the passage on the electric oil pump 7 side.

Here, in the present embodiment, by executing idle stop/start control for engine 1, and continuously supplying oil to start clutch 2 and continuously variable transmission 3 by electric oil pump 7 during idle stop, transmission of torque to the drive wheels is smoothly performed at the time of restart after idle stop, and the occurrence of torque shock resulting from insufficient discharge pressure of mechanical oil pump 6 immediately after restart of engine 1 is suppressed.

In this way, control unit 4 mainly executes start and transmission control of the vehicle. However, in the present embodiment, in addition to this, the occurrence of idling of electrical oil pump 7 is determined during the operation of electric oil pump 7, and when the occurrence of idling is detected, control unit 4 displays a warning to a driver and restricts execution of idle stop/start control. A display device 21 receives a control signal from control unit 4 and displays a warning indicating that idling has occurred in electric oil pump 7. Hereunder, control for determining idling of electric oil pump 7 (idling determination routine) is explained. Idling of electric oil pump 7 occurs, for example, due to a decrease in oil level in oil pan 8, mixing of bubbles into the oil passage, or oil leaks from an improperly connected portion in the hydraulic piping. In the present embodiment, at least idling attributable to these events is assumed as the idling to be determined.

Figure 2:
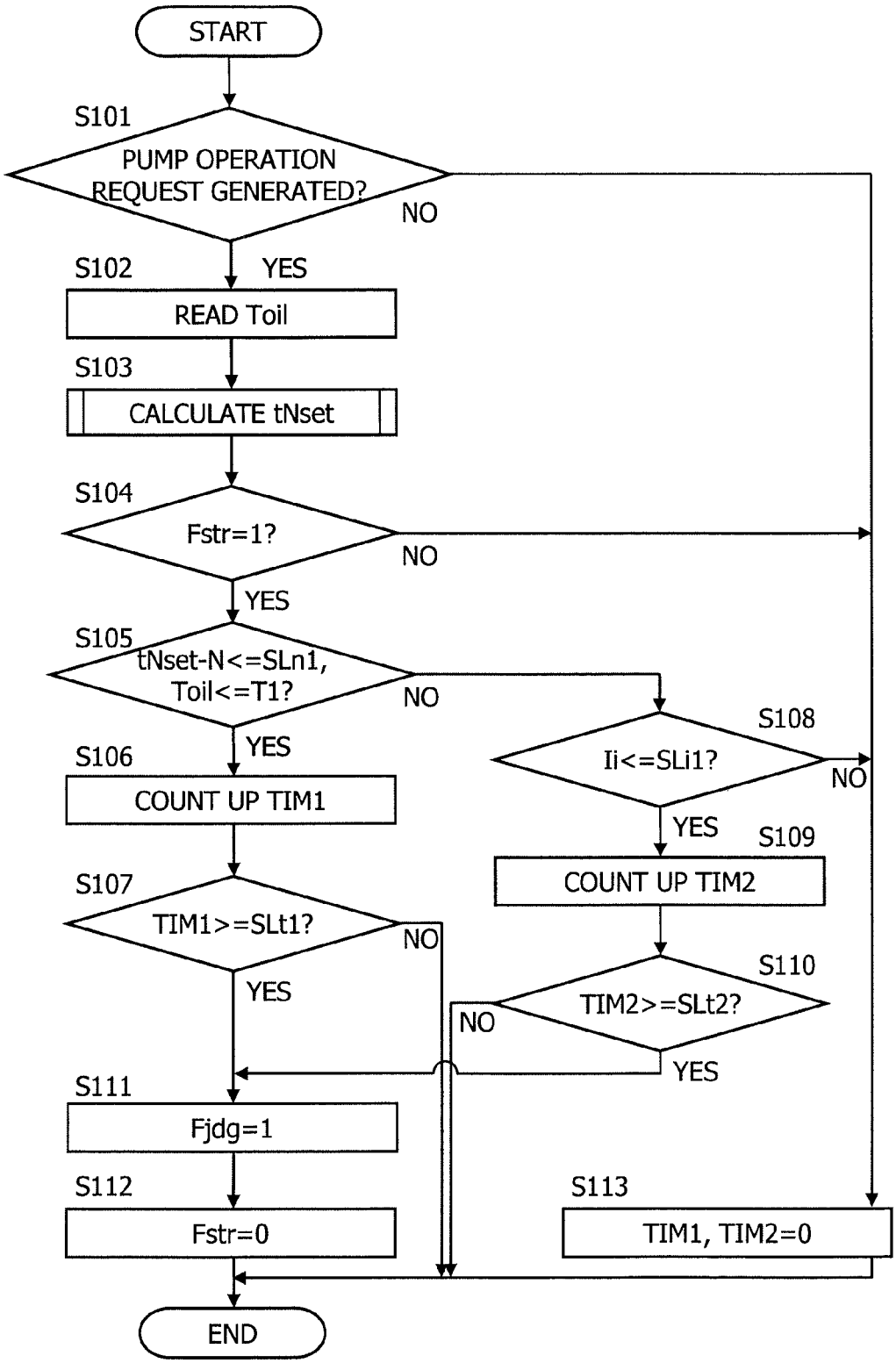
FIG. 2 is a flowchart of an idling determination routine executed by the control apparatus.

FIG. 2 is a flowchart of the idling determination routine according to the present embodiment. This routine is executed by control unit 4 for each predetermined time interval.

In S101, it is determined whether there is an operation request of electric oil pump 7. When there is an operation request of the pump, the process proceeds to step S102, and in other cases, proceeds to step S113.

In S102, oil temperature Toil is read. In the present embodiment, the oil temperature Toil is detected by a temperature sensor 11 provided in oil pan 8.

In S103, a target number of revolutions tNset of electric oil pump 7 is calculated, and feedback control of the number of revolutions is executed so that the actual number of revolutions N of electric oil pump 7 approaches the calculated target number of revolutions tNset. The target number of revolutions tNset is calculated by a process for calculating the target number of revolutions shown in FIG. 3.

In step S104, it is determined whether an idling determination start flag Fstr is set to 1. When set to 1, the process proceeds to step S105, and in other cases, proceeds to step S113. The idling determination start flag Fstr is set according to the process (process for determining diagnosis start) shown in FIGS. 4 to 8.

In step S105, the actual number of revolutions N of electric oil pump 7 is detected, to determine whether a difference between the target number of revolutions tNset and the detected number of revolutions N is equal to or less than a predetermined value SLn1, and the oil temperature Toil is equal to or lower than T1. When these conditions are satisfied, that is, when the number of revolutions N of electric oil pump 7 follows the target number of revolutions tNset in an environment in which oil is in a low-temperature state, the process proceeds to step S106, and in other cases, proceeds to step S108.

In step S106, a first timer TIM1 is counted up (for example, TIM1=TIM1+1).

In step S107, it is determined whether the timer TIM1 after count-up has reached a predetermined value SLt1. If the predetermined value SLt1 has been reached, the process proceeds to step S111, and if not, the process ends.

In step S108, the phase current Ii of brushless motor 71 that drives electric oil pump 7 is detected, and it is determined whether the detected phase current (specifically, phase current filter value) Ii is equal to or less than a predetermined value SLi1. If equal to or less than the predetermined value SLi1, that is, if the load of electric oil pump 7 (pump load) decreases beyond a range, whose lower limit is determined by the predetermined value SLi1, in an environment in which oil is at a temperature having a value larger than the predetermined value T1, the process proceeds to step S109, and in other cases, proceeds to step S113. In the present embodiment, the phase current filter value Ii is a value obtained by performing a process such as primary filtering with respect to the phase current of brushless motor 71 measured by a current sensor. A drive command value (current command value) with respect to brushless motor 71 can be used as a substitute for the phase current filter value Ii.

In step S109, a second timer TIM2 is counted up (for example, TIM2=TIM2+1).

In step S110, it is determined whether the timer TIM2 after count-up has reached a predetermined value SLt2. If the predetermined value SLt2 has been reached, the process proceeds to step S111, and if not, the process ends. Here, the order of the processes in steps S105 to S107 and the processes in steps S108 to S110 can be reversed, to determine first whether the oil temperature Toil is in a higher temperature region than the predetermined value T1, and the phase current Ii is equal to or less than the predetermined value SLi1. When the determination result is NO, it can be determined whether the difference between the number of revolutions (=tNset−N) is equal to or less than the predetermined value SLn1.

In step S111, an idling determination fixing flag Fjdg is set to 1, to confirm the determination that idling has occurred in electric oil pump 7. Upon reception of this determination, control unit 4 outputs a warning display signal to display device 21, and outputs a control signal for restricting execution of the idle stop/start control with respect to an engine control unit (not shown). The engine control unit has a function of executing the idle stop/start control of engine 1, and upon reception of the control signal from control unit 4, suspends the execution of the idle stop/start control.

In step S112, the idling determination start flag Fstr is reset (Fstr=0).

In step S113, the first and second timers TIM1 and TIM2 are each reset (TIM1=0, TIM2=0).

Figure 3:
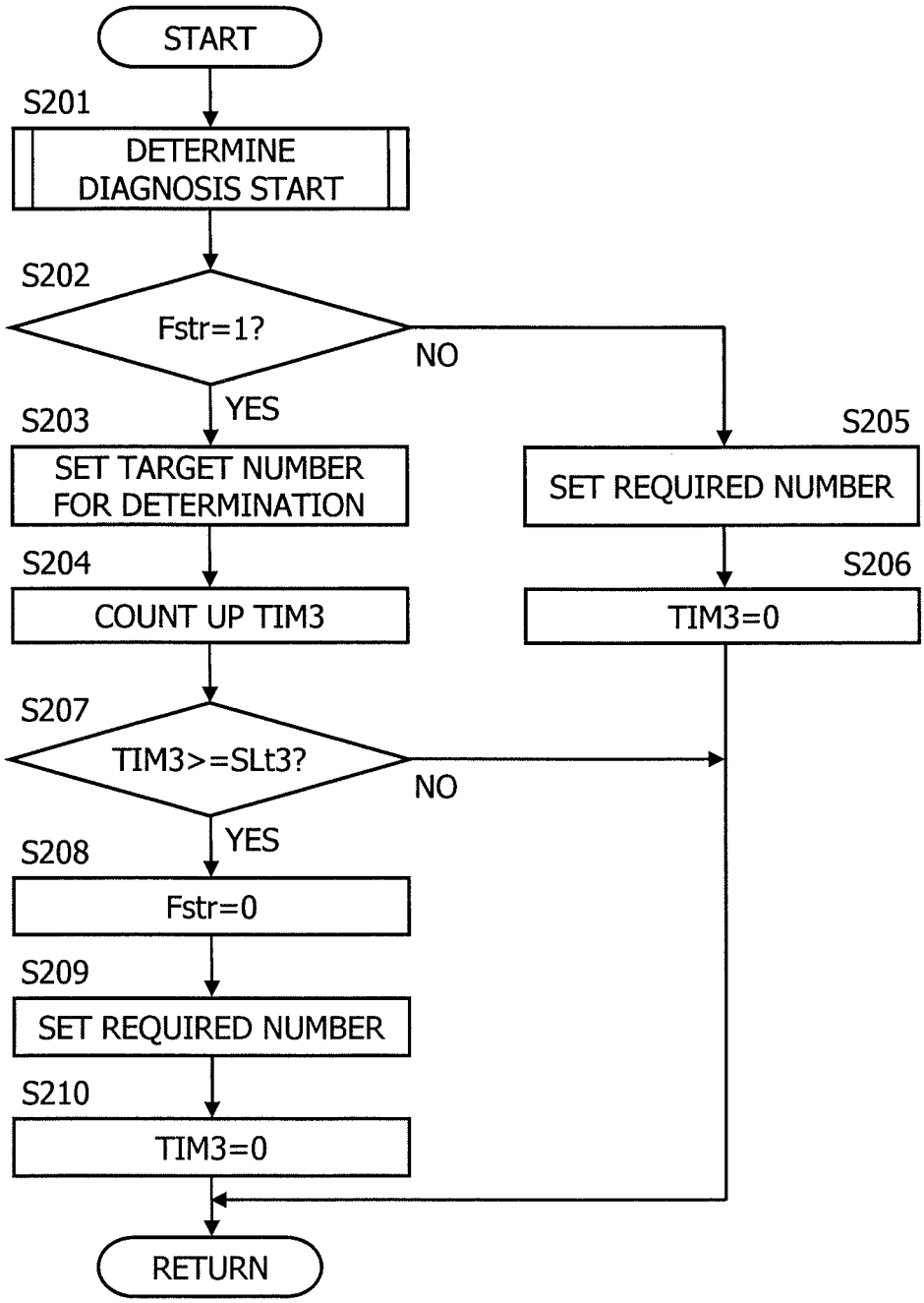
FIG. 3 is a flowchart showing a flow in a process for calculating a target number of revolutions in the idling determination routine.

FIG. 3 is a flowchart showing a flow in a process for calculating the target number of revolutions.

In step S201, a process for determining diagnosis start is executed, and the idling determination start flag Fstr is set to 1, when there is a suspicion (foresight) of the occurrence of idling. The process for determining diagnosis start is performed according to the flow shown in the flowcharts in FIG. 4 and FIGS. 5 to 8.

In step S202, it is determined whether the idling determination start flag Fstr is set to 1. When set to 1, the process proceeds to step S203, and in other cases, proceeds to step S205.

Figure 9:
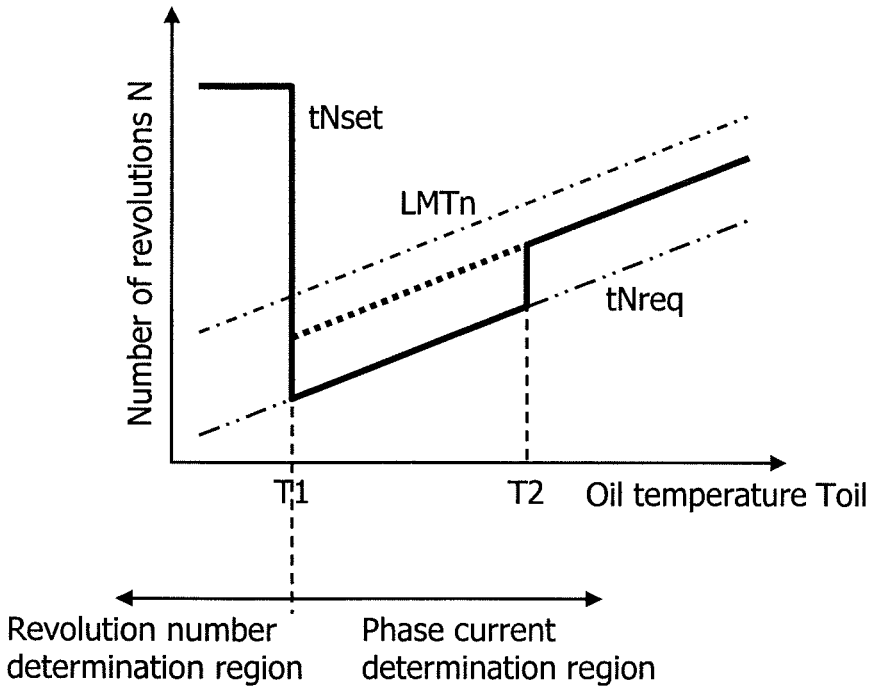
FIG. 9 is an explanatory diagram showing an outline of a change in a target number of revolutions with respect to oil temperature.

In step S203, the target number of revolutions tNset of electric oil pump 7 is set to the target number of revolutions for determination. In the present embodiment, the target number of revolutions for determination is set based on the oil temperature Toil, and as shown in FIG. 9, is set to increase with a rise of the oil temperature Toil, as a tendency throughout the whole temperature assumption region. However, in a low temperature region lower than T1 and in a high temperature region higher than T2, the target number of revolutions for determination is set to a larger value as compared to an intermediate region (T1 to T2) other than these regions. Specifically, in the low temperature region lower than T1, the target number of revolutions for determination is set to a value exceeding an upper limit LMTn of a range practically allowed for electric oil pump 7 (control acceptable range) from a standpoint of operation limitation of brushless motor 71, whereas in a high temperature region higher than T2, it is set within the control acceptable range, which is equal to or lower than the upper limit LMTn. In the present embodiment, the target number of revolutions for determination set for the low temperature region is a maximum number of revolutions determined based on the rating of brushless motor 71. On the other hand, in the intermediate region (T1 to T2), it is set to the number of revolutions (required number of revolutions described below) tNreq corresponding to the operation request of electric oil pump 7.

In step S204, a third timer TIM3 is counted up (for example, TIM3=TIM3+1).

In step S205, the target number of revolutions tNset of electric oil pump 7 is set to the number of revolutions corresponding to the operation request of electric oil pump 7 (required number of revolutions tNreq). In the present embodiment, the required number of revolutions tNreq is linearly increased and set according to a rise of the oil temperature Toil as shown by the two-dot chain line in FIG. 9.

In step S206, the third timer TIM3 is reset (TIM3=0).

In step S207, it is determined whether the timer TIM3 after count-up has reached a predetermined value SLt3. If the predetermined value SLt3 has been reached, the process proceeds to step S208, and if not, the process returns to the routine illustrated in FIG. 2.

In step S208, the idling determination start flag Fstr is reset (Fstr=0).

In step S209, the target number of revolutions tNset of electric oil pump 7 is set to the required number of revolutions tNreq. Consequently, excessive heat generation of brushless motor 71 due to continuous application of a large load is prevented by decreasing the number of revolutions of electric oil pump 7 to the required number of revolutions tNreq when the occurrence of idling is not detected within a time set by the predetermined value SLt3.

In step S210, the third timer TIM3 is reset (TIM3=0).

Figure 4:
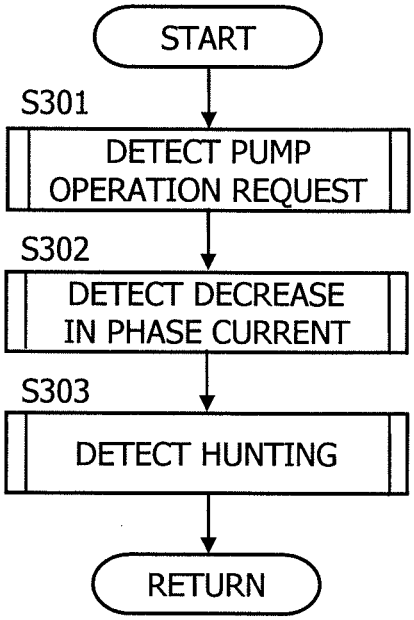
FIG. 4 is a flowchart showing a flow in a process for determining diagnosis start in the idling determination routine.

FIG. 4 is a flowchart showing a flow in a process for determining diagnosis start.

Figure 5:
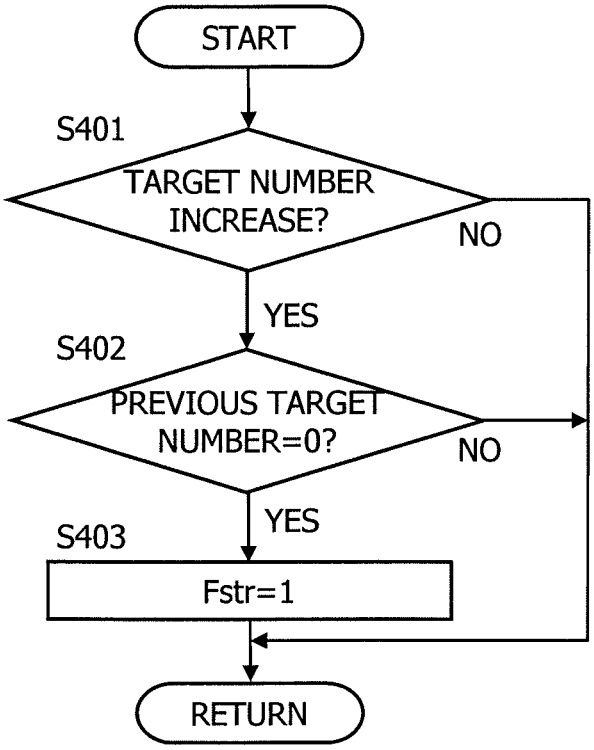
FIG. 5 is a flowchart showing a flow in a process for detecting a pump operation request.

In step S301, a process for detecting a pump operation request is executed according to the flow shown in the flowchart in FIG. 5.

Figure 6:
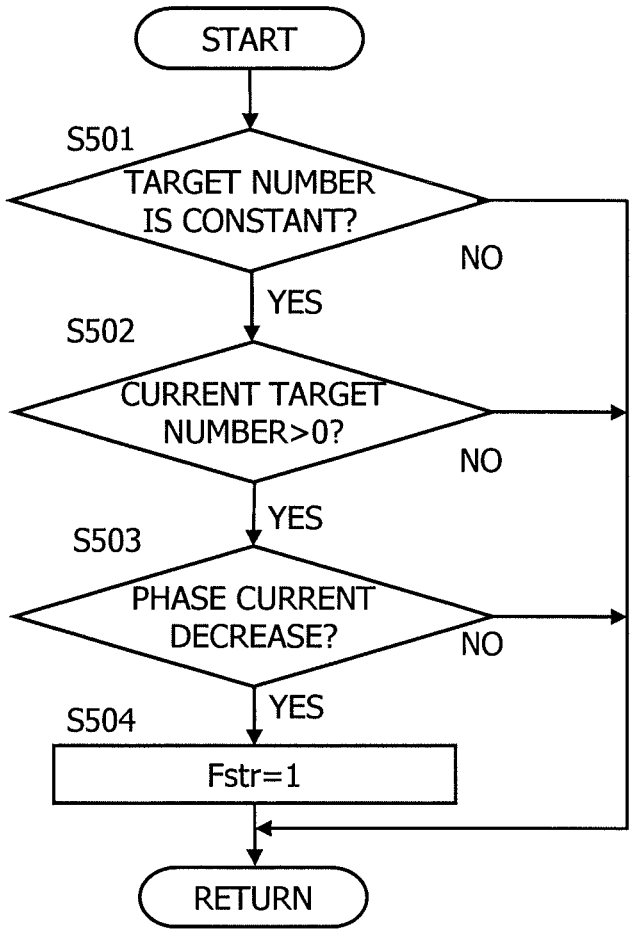
FIG. 6 is a flowchart showing a flow in a process for detecting a decrease in phase current.

In step S302, a process for detecting a decrease in phase current is executed according to the flow shown in the flowchart in FIG. 6.

Figure 7:
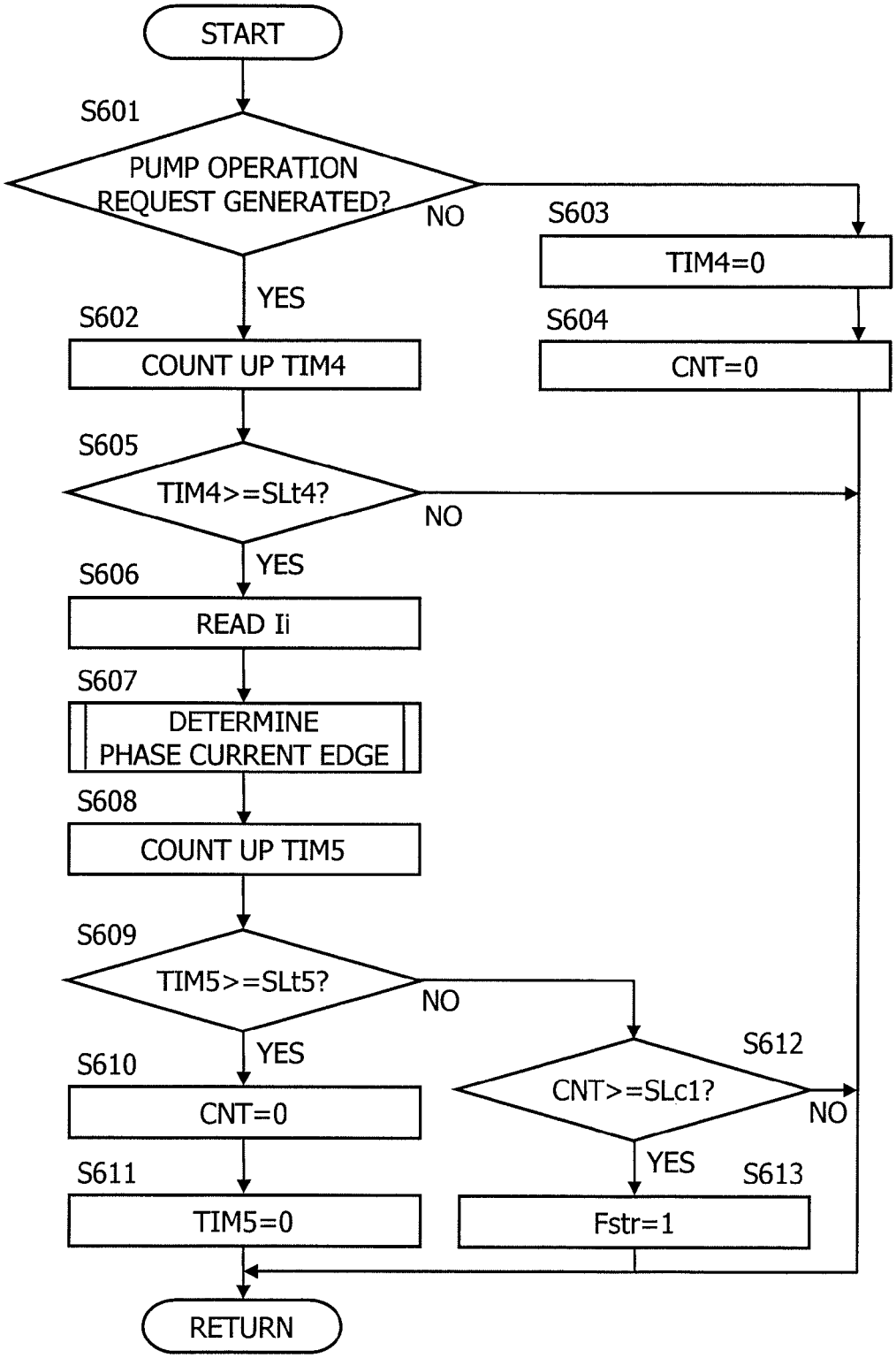
FIG. 7 is a flowchart showing a flow in a process for detecting hunting.
Figure 8:
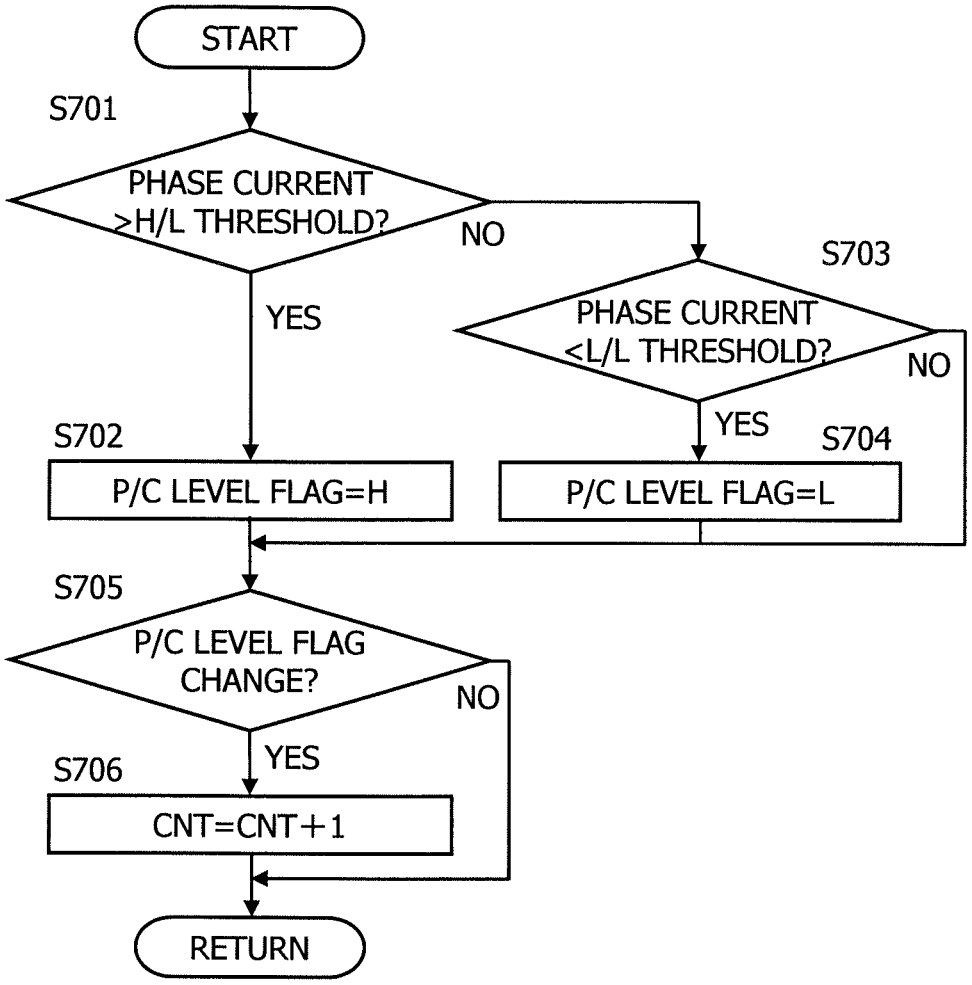
FIG. 8 is a flowchart showing a flow in a process for counting a phase current edge.

In step S303, a process for detecting hunting is executed according to the flow shown in the flowcharts in FIGS. 7 and 8.

In this way, in the present embodiment, when there is an operation request of electric oil pump 7 and when there is a suspicion (foresight) of the occurrence of idling during the operation of electric oil pump 7, determination of idling is executed. However, the determination can be executed regularly, for example, at predetermined time intervals.

FIG. 5 is a flowchart showing a flow in the process for detecting a pump operation request.

In step S401, it is determined whether the target number of revolutions tNset (the required number of revolutions tNreq because it is before the start of determination) of electric oil pump 7 has increased. For example, it is determined whether a difference ($=tNset-tNset_{n-1}$) between the current target number of revolutions tNset and the previous target number of revolutions $tNset_{n-1}$ (that is, in a routine before execution of one process) is larger than a predetermined value. When the difference increases, the process proceeds to step S402, and in other cases, the process returns to the routine in FIG. 4 illustrating a basic flow in the process for determining diagnosis start (hereinafter, referred to as a "determination basic routine").

In step S402, it is determined whether the previous target number of revolutions $tNset_{n-1}$ is zero. When the previous target number of revolutions $tNset_{n-1}$ is zero, the process proceeds to step S403, and in other cases, the process returns to the determination basic routine.

In step S403, the idling determination start flag Fstr is set to 1.

FIG. 6 is a flowchart showing the flow in a process for detecting a decrease in phase current.

In step S501, it is determined whether the target number of revolutions tNset (the required number of revolutions tNreq) of electric oil pump 7 is constant. For example, an absolute value of the difference between the current target number of revolutions tNset and the target number of revolutions $tNset_{n-m}$ before a predetermined time is calculated and it is determined whether this is equal to or less than a predetermined value. When the target number of revolutions tNset is constant, the process proceeds to step S502, and in other cases, the process returns to the determination basic routine.

In step S502, it is determined whether the current target number of revolutions tNset is larger than zero. When the current target number of revolutions tNset is larger than zero, control proceeds to step S503, and in other cases, control returns to the determination basic routine.

In step S503, it is determined whether the phase current Ii of brushless motor 71 has decreased. The decrease in the phase current Ii is determined, for example, when the current phase current filter value Ii has decreased from a phase current filter value $Ii_{n-m}$ before a predetermined time by a predetermined value or more. When the decrease occurs, the process proceeds to step S504, and in other cases, the process returns to the determination basic routine. In this way, in the present embodiment, it is determined if there is a suspicion of the occurrence of idling using the phase current Ii. However, a decrease of a pump load can be detected by a variation in a feedback correction amount in the control of number of revolutions, and when the feedback correction amount exceeds a predetermined value, it can be determined that there is a suspicion of the occurrence of idling.

In step S504, the idling determination start flag Fstr is set to 1.

FIG. 7 is a flowchart showing the flow in a process for detecting hunting.

In step S601, it is determined whether there is a pump operation request. When there is a pump operation request, the process proceeds to step S602, and in other cases, proceeds to step S603.

In step S602, a fourth timer TIM4 is counted up (for example, timer TIM4=TIM4+1).

In step S603, the fourth timer TIM4 is reset (TIM4=0).

In step S604, a phase current edge counter CNT is reset (CNT=0).

In step S605, it is determined whether the timer TIM4 after count-up has reached a predetermined value SLt4. If the predetermined value SLt4 has been reached, the process proceeds to step S606, and if not, the process returns to the determination basic routine.

In step S606, the phase current Ii of electric oil pump 7 is read.

In step S607, a process for determining a phase current edge is executed according to the flow shown in the flowchart of FIG. 8.

In step S608, a fifth timer TIM5 is counted up (for example, timer TIM5=TIM5+1).

In step S609, it is determined whether the timer TIM5 after count-up has reached a predetermined value SLt5. If the predetermined value SLt5 has been reached, the process proceeds to step S610, and if not (in other words, when it is within a period of time set by the predetermined value SLt5 since generation of the pump operation request), the process proceeds to step S612.

In step S610, the phase current edge counter CNT is reset (CNT=0).

In step S611, the fifth timer TIM5 is reset (TIM5=0).

In step S612, it is determined whether the phase current edge counter CNT has reached a predetermined value SLc1. If the predetermined value SLc1 has been reached, the process proceeds to step S613, and if not, the process returns to the determination basic routine. When switchover between phase current level flags H and L has occurred over a plurality of times more than the predetermined value SLc1 within a predetermined time since generation of the pump operation request, it is determined that hunting has occurred. Hunting of the phase current Ii occurs resulting mainly from pressure pulsation due to mixing of bubbles into the oil passage. Consequently, it can be determined if there is a suspicion of the occurrence of idling due to mixing of bubbles, based on the detection of hunting.

In step S613, the idling determination start flag Fstr is set to 1.

FIG. 8 is a flowchart showing the flow in a process for counting a phase current edge.

In step S701, it is determined whether the phase current Ii is larger than a level threshold on an upper limit side (hereinafter, referred to as a "high level threshold"). When the phase current Ii is larger than the high level threshold, the process proceeds to step S702, and in other cases, proceeds to step S703.

In step S702, the phase current level flag is set to the value H indicating a high level.

In step S703, it is determined whether the phase current Ii is smaller than a level threshold on a lower limit side (hereinafter, referred to as a "low level threshold"). When the phase current Ii is smaller than the low level threshold, the process proceeds to step S704, and in other cases, proceeds to step S705.

In step S704, the phase current level flag is set to the value L indicating a low level.

In step S705, it is determined whether there is a change in the phase current level flag between the previous time and this time. If there is a change, the process proceeds to step S706, and if not, the process returns to the determination basic routine.

In step S706, the phase current edge counter CNT is incremented by a predetermined value (for example, 1).

Figure 10:
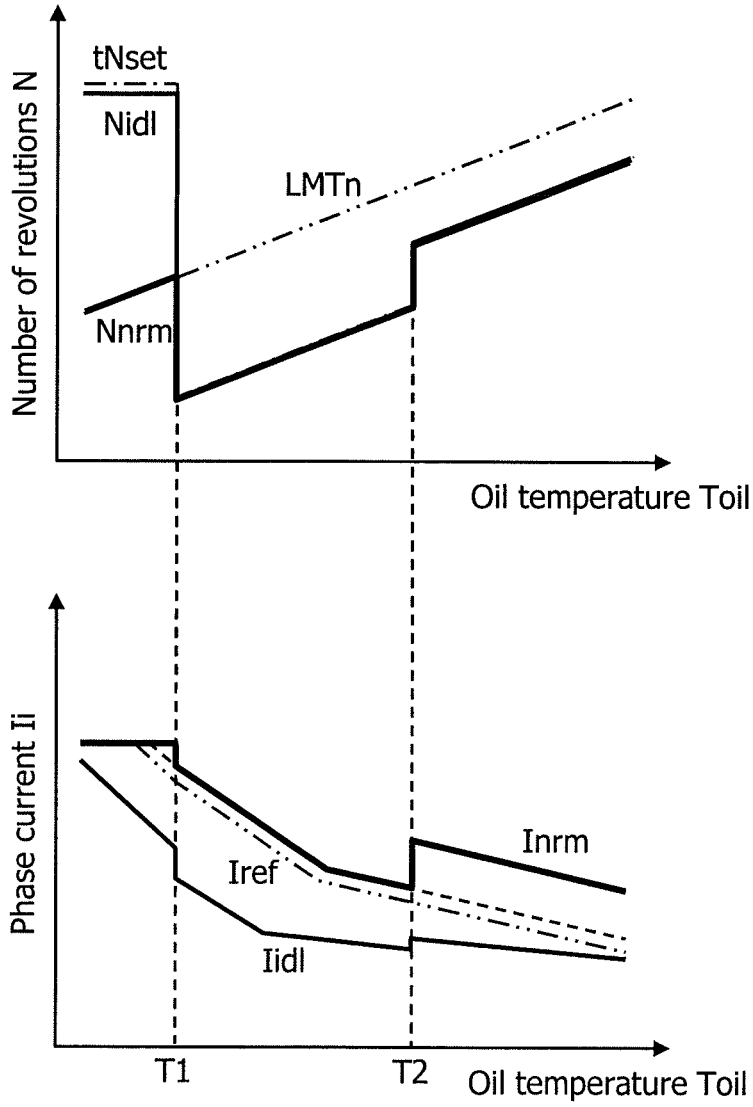
FIG. 10 is an explanatory diagram showing one example of changes in an actual number of revolutions of a brushless motor and a phase current, in a normal state time and a time when idling occurs.

FIG. 10 is an explanatory diagram showing one example of changes in the actual number of revolutions N of brushless motor 71 and the phase current Ii, in a normal state time and a time when idling occurs. The effects obtained by the present embodiment are explained below together with an operation in the present embodiment, with reference to FIG. 10. In FIG. 10, the number of revolutions N and the phase current Ii are respectively shown by a thick solid line (Nnrm, Inrm) in the normal state time and by a finer solid line (NidI, IidI) in the time when idling occurs.

In the present embodiment, as shown in FIG. 9, when performing idling determination, the target number of revolutions tNset of electric oil pump 7 is set to a value exceeding an upper-limit number of revolutions LMTn in a low temperature region lower than T1, and is set to a value within the control acceptable range equal to or lower than the upper-limit number of revolutions LMTn in a high temperature region higher than T2. In an intermediate region other than these regions, it is set to a value corresponding to an operation request of electric oil pump 7 (required number of revolutions tNreq).

According to such setting, the occurrence of idling can be determined without increasing power consumption in the intermediate region, and in addition, the occurrence of idling can be determined easily even in the low temperature region and the high temperature region. Because the occurrence of idling can be determined not only in the intermediate region but also in the low temperature region and the high temperature region, idling can be detected immediately after the occurrence thereof, and measures for avoiding trouble due to insufficient oil level or insufficient oil pressure can be taken. For example, in the present embodiment, malfunction of start clutch 2 and continuously variable transmission 3 due to insufficient oil pressure, or excessive drive requests with respect to electric oil pump 7 and brushless motor 71 when power increase control is performed for compensating for an insufficient amount with respect to insufficient supply of oil can be avoided. The excessive drive request with respect to electric oil pump 7 and the like causes over speed rotation in electric oil pump 7 and brushless motor 71, thereby causing excessive heat generation in electric oil pump 7 and the like, or wrong diagnosis with respect to pump abnormality. In addition, when lubrication and cooling of a sliding portion are performed by the oil drawn up by electric oil pump 7 as described below, seizure due to insufficient supply of oil can be avoided.

With reference to FIG. 10, in the low temperature region lower than T1, an increase in the phase current Ii (Inrm) is suppressed from a standpoint of operation limitation of brushless motor 71 with respect to an increase in pump resistance ("viscous friction resistance of oil) due to an increase in oil viscosity. Consequently, the difference of phase current Ii between in the normal state time and the time when idling occurs (=Inrm−IidI) is reduced, thereby making determination based on the phase current Ii difficult. Here, by largely increasing the target number of revolutions tNset to exceed the control acceptable range, the phase current Inrm reaches the upper limit in the normal state time in which idling does not occur. As a result, the number of revolutions Nnrm of electric oil pump 7 does not follow the target number of revolutions tNset, to increase the difference between the target number of revolutions tNset and the number of revolutions Nnrm. On the other hand, when idling occurs, the phase current IidI does not reach the upper limit, and the operation limitation does not work. As a result, the number of revolutions NidI of electric oil pump 7 changes following the target number of revolutions tNset. Consequently, in the low temperature region, by monitoring a change in the actual number of revolutions N with respect to an increase in the target number of revolutions tNset, the occurrence of idling can be easily determined.

On the other hand, in the high temperature region higher than T2, pump resistance decreases due to a decrease of oil viscosity. Consequently, the difference in the phase current Ii between in the normal state time and the time when idling occurs decreases, thereby making determination based on the phase current Ii difficult. Here, in electric oil pump 7 in which pump section clearances are large and oil discharge flow rate with respect to the same number of revolutions is low, this tendency is noticeable. Specifically, this is because, in electric oil pump 7 having large pump section clearances, even if idling does not occur, phase current Iref becomes relatively small because of the low pump discharge flow rate, and consequently, discrimination from a pump in which although pump section clearances are small, idling has occurred (phase current IidI), becomes difficult. According to the present embodiment, when determining idling of electric oil pump 7, the difference in the phase current Ii between in the normal state time and the time when idling occurs (=Inrm−IidI) can be increased by increasing the target number of revolutions tNset more than the required number of revolutions tNreq to intentionally increase the number of revolutions N of electric oil pump 7, so that the occurrence of idling can be determined based on the phase current Ii.

In the intermediate region, the influence of oil viscosity is not noticeable, and a difference sufficient for determination is generated in the phase currents Inrm and IidI between in the normal state time and the time when idling occurs. Therefore the occurrence of idling can be determined according to whether the phase current Ii of brushless motor 71 when electric oil pump 7 is operated with the required number of revolutions tNreq is larger or smaller than the predetermined value SLi1.

Naturally, it is preferred to set the respective predetermined values SLn1 and SLi1 for determination of the occurrence of idling to an optimum value, according to the oil temperature Toil. Moreover when determination is performed based on the phase current Ii, the predetermined value SLi1 is preferably set with a downward trend with respect to an increase in the oil temperature Toil, and also adapted so that the phase currents Inrm and IidI with respect to the normal state time and the time when idling occurs can be discriminated in both of the regions on the lower temperature side than T2 and the higher temperature side than T2.

Figure 11:
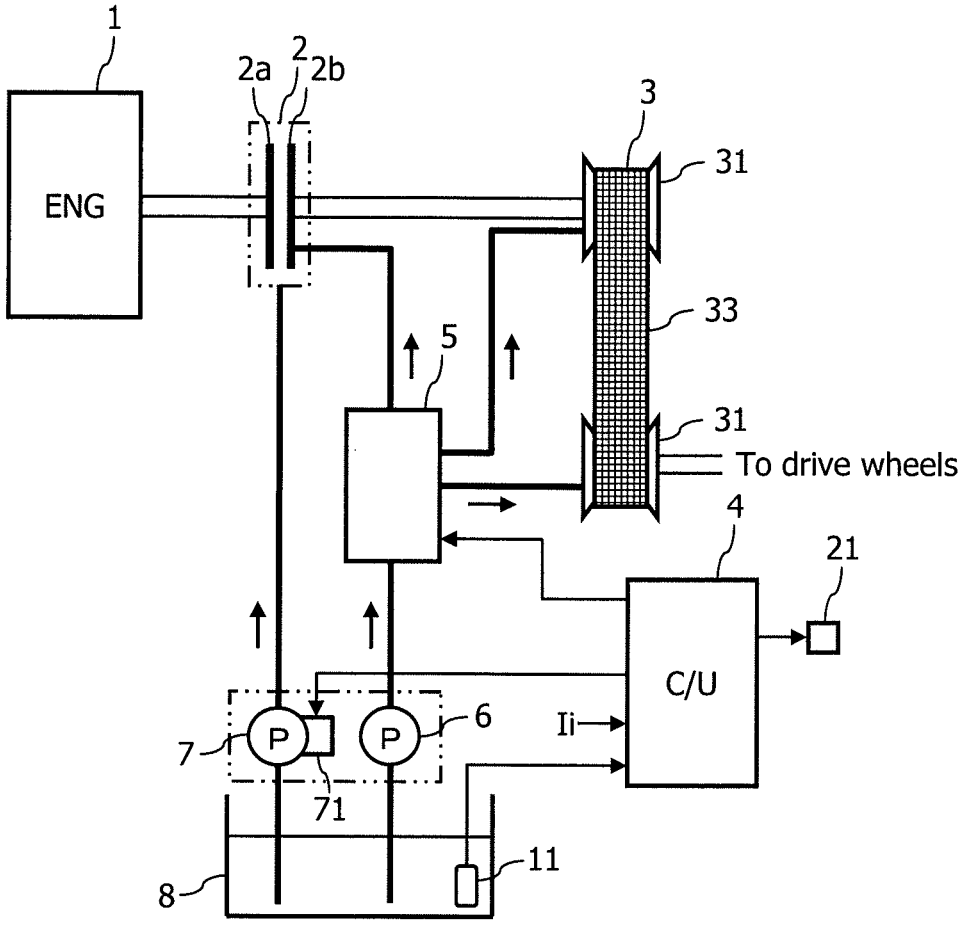
FIG. 11 is a configuration diagram of a vehicle transmission system including an apparatus for controlling an electric oil pump according to another embodiment of the present invention.

In the explanation above, a case in which electric oil pump 7 is installed in the oil passage that bypasses mechanical oil pump 6, and coupling hydraulic pressure of start clutch 2 is formed by electric oil pump 7, is explained. However, the present invention is not limited thereto, and can be applied to a case in which mechanical oil pump 6 and electric oil pump 7 are installed in an independent oil passage, respectively. For example, in a vehicle transmission system shown in FIG. 11, a second hydraulic system for lubrication and cooling of start clutch 2 and the like is arranged independently of a first hydraulic system in which coupling hydraulic pressure of start clutch 2 and transmission hydraulic pressure of continuously variable transmission 3 are formed by mechanical oil pump 6, and electric oil pump 7 is installed in the second hydraulic system. In the low temperature region (Toil T1) in which oil viscosity increases, at the time of determination of idling, the target number of revolutions tNset of electric oil pump 7 is increased exceeding the control acceptable range, to increase the difference in the number of revolutions N (=Nnrm−NidI) between in the normal state time and the time when idling occurs, and the occurrence of idling is determined based on the number of revolutions N. On the other hand, in the high temperature region (Toil≥T2) in which oil viscosity decreases, the target number of revolutions tNset is increased more than the required number of revolutions tNreq to increase the difference in the phase current Ii (=Inrm−IidI) between in the normal state time and the time when idling occurs, so that the occurrence of idling is determined based on the phase current Ii. In this way, idling determination can be performed even in the low temperature region and the high temperature region in which determination based on the pump load under the required number of revolutions becomes difficult. As a result, idling can be detected immediately after the occurrence thereof without waiting for a shift to the intermediate region, and measures for avoiding trouble attributable to insufficient supply of oil to the sliding portions can be taken. For example, when the occurrence of idling is determined, execution of idle stop/start control is restricted to avoid execution of idle stop under insufficient conditions of lubrication and cooling, thereby enabling to prevent seizure in start clutch 2.

Moreover, the present invention can be applied not only to a frictional joint element represented by a clutch or the like, but also to an electric oil pump that supplies oil to various sliding portions and heat generating portions that require lubrication or cooling or both.

Furthermore, in the above explanation, a case in which a target number of revolutions for determination higher than the required number of revolutions tNreq is set for the low temperature region and the high temperature region is explained. However, when the oil temperature use range is narrow, the region in which the target number of revolutions tNset is increased for determination of idling is limited to only one of the low temperature region and high temperature region, and in the other region (a region on a relatively high temperature side excluding the low temperature region or a region on a relatively low temperature side excluding the high temperature region), the occurrence of idling can be determined by monitoring a decrease in the phase current Ii under the required number of revolutions tNreq. In actual application, a case can be assumed where a region in which the determination can be performed based on either the number of revolutions N or the phase current Ii (there is no wrong diagnosis) is present. In such a case, the determination can be performed by either determination method, or an intermediate point for switching the determination method can be set in the region.

Furthermore, in the above explanation, at the time of performing idling determination, the target number of revolutions for determination is switched between the high temperature region higher than T2 and the intermediate region (T1 to T2), and in the intermediate region, the required number of revolutions tNreq is set to the target number of revolutions for determination, while in the high temperature region, a target number of revolutions tNset for determination higher than the required number of revolutions tNreq is set. However, the present invention is not limited thereto, and a target number of revolutions for determination higher than the required number of revolutions tNreq can be set over the whole region in which the occurrence of idling is determined based on the pump load (for example, in the region on a higher temperature side than T1) (refer to the dotted line shown in FIG. 9).

Furthermore, when electric oil pump 7 is assembled, or repaired or replaced, determination of idling can be restricted at the time of first powering on thereafter until electric oil pump 7 rotates more than a predetermined number of times and oil is filled in the pump, piping, and the like. As a result, after the assembly or the like, wrong determination in an empty state can be prevented.

The process in step S203 in the flowchart shown in FIG. 3 and the process in step S103 in the flowchart shown in FIG. 2 (feedback control of the number of revolutions) realize the function of a "determination time control section". The process in steps S105 and S108 in the flowchart shown in FIG. 2 realize the function of a "pump operation state detecting section" and an "idling determining section". The process in step S111 in the flowchart shown in FIG. 2 realizes the function of a "control signal output section". In the flowchart shown in FIG. 2, the process in step S105 realizes the function of a "revolution number detecting section" and a "first idling determining section", and the process in step S108 realizes a "pump load detecting section" and a "second idling determining section". The region lower than the predetermined value T1 shown in FIG. 9 corresponds to the "first region", and the region higher than the predetermined value T2 corresponds to the "second region". The temperature sensor 11 realizes the function of an "oil temperature sensor", and display device 21 realizes the function of a "warning display section".

The entire contents of Japanese Patent Application No. 2011-062062, filed Mar. 22, 2011, on which priority is claimed, are incorporated herein by reference.

While only a select embodiment have been chosen to illustrate and describe the present invention, it will be apparent to those skilled in the art from this disclosure that various changes and modifications can be made herein without departing from the scope of the invention as defined in the appended claims.

Furthermore, the foregoing descriptions of the embodiments according to the present invention are provided for illustration only, and it is not for the purpose of limiting the invention, the invention as claimed in the appended claims and their equivalents.

What is claimed is:

1. An apparatus for controlling an electric oil pump that supplies oil using an electric motor as a power source, comprising:

a determination time control section that sets a target number of revolutions for determination higher than a required number of revolutions corresponding to an operation request of the electric oil pump, and executes control of the electric motor so that the number of revolutions of the electric oil pump approaches the target number of revolutions for determination;

a pump operation state detecting section that detects an operation state of the electric oil pump while executing the control of the electric motor;

an idling determining section that determines the occurrence of idling in the electric oil pump based on an operation state detection value detected by the pump operation state detecting section; and a control signal output section that outputs a control signal corresponding to a determination result obtained by the idling determining section.

2. An apparatus according to claim 1, wherein the operation state of the electric oil pump is a load of the electric oil pump while executing the control of the electric motor.

3. An apparatus according to claim 2, wherein the idling determining section determines that the idling has occurred, when the load of the electric oil pump while executing the control of the electric motor is equal to or less than a predetermined value.

4. An apparatus according to claim 2, wherein the determination time control section switches over the target number of revolutions for determination between cases in which the oil is in a high temperature state or not, and sets a target number of revolutions for determination higher than the required number of revolutions, only when the oil is in the high temperature state.

5. An apparatus according to claim 1, wherein the operation state of the electric oil pump is an actual number of revolutions of the electric oil pump while executing the control of the electric motor.

6. An apparatus according to claim 5, wherein the idling determining section determines that the idling has occurred, when a difference between the target number of revolutions for determination and the actual number of revolutions of the electric oil pump while executing the control of the electric motor is equal to or less than a predetermined value.

7. An apparatus according to claim 5, wherein the determination time control section switches over the target number of revolutions for determination between cases in which the oil is in a low temperature state or not, and sets a target number of revolutions for determination higher than the required number of revolutions, only when the oil is in the low temperature state.

8. An apparatus according to claim 1, wherein the pump operation state detecting section comprises:

a revolution number detecting section that detects the actual number of revolutions of the electric oil pump while executing the control of the electric motor, in a first region in which the temperature of the oil is lower than a first temperature; and a pump load detecting section that detects a load of the electric oil pump while executing the control of the electric motor as a pump load, in a second region in which the temperature of the oil is higher than a second temperature, and the idling detecting section comprises:

a first idling determining section that determines the occurrence of idling in the electric oil pump in the first region based on the number of revolutions detected by the revolution number detecting section; and a second idling determining section that determines the occurrence of idling in the electric oil pump in the second region based on the pump load detected by the pump load detecting section.

9. An apparatus according to claim 8, wherein the first idling determining section determines that the idling has occurred, when a difference between the target number of revolutions for determination and the actual number of revolutions of the electric oil pump while the executing control of the electric motor is equal to or less than a predetermined value, and the second idling determining section determines that the idling has occurred, when the load of the electric oil pump while executing the control of the electric motor is equal to or less than a predetermined value.

10. An apparatus according to claim 8, further comprising an oil temperature sensor that detects the temperature of the oil, and the determination time control section sets the target number of revolutions for determination based on the oil temperature detected by the oil temperature sensor.

11. An apparatus according to claim 8, wherein the target number of revolutions for determination set for the first region has a value larger than the target number of revolutions for determination set for the second region.

12. An apparatus according to claim 1, further comprising a warning display section that displays a warning relating to the occurrence of the idling, upon reception of the control signal output from the control signal output section.

13. An apparatus according to claim 1 in which the electric oil pump supplies oil to a hydraulic element related to idle stop/start control of a vehicle engine, wherein the control signal is a signal for restricting execution of the idle stop/start control.

14. An apparatus according to claim 1, wherein when operation of the electric oil pump is started from a halt condition, the control of the electric motor is executed to determine the occurrence of the idling.

15. An apparatus according to claim 1, wherein when the actual pump load decreases under a condition in which the load of the electric oil pump is constant, the control of the electric motor is executed to determine the occurrence of the idling.

16. An apparatus according to claim 1, further comprising a motor current control section that controls phase current of the electric motor so that the number of revolutions of the electric oil pump approaches the required number of revolutions, and when hunting occurs in the phase current controlled by the motor current control section, the control of the electric motor is executed to determine the occurrence of the idling.

17. A method of controlling an electric oil pump that supplies oil using an electric motor as a power source, comprising:

setting a target number of revolutions for determination higher than a required number of revolutions corresponding to an operation request of the electric oil pump, and executing control of the electric motor so that the number of revolutions of the electric oil pump approaches the target number of revolutions for determination;

detecting an operation state of the electric oil pump while executing the control of the electric motor;

determining the occurrence of idling in the electric oil pump based on an operation state detection value of the electric oil pump; and outputting a control signal corresponding to a determination result of the occurrence of the idling.

18. An apparatus for controlling an electric oil pump that supplies oil using an electric motor as a power source, comprising:

means for setting a target number of revolutions for determination higher than a required number of revolutions corresponding to an operation request of the electric oil pump, and executing control of the electric motor so that the number of revolutions of the electric oil pump approaches the target number of revolutions for determination;

means for detecting an operation state of the electric oil pump while executing the control of the electric motor;

means for determining the occurrence of idling in the electric oil pump based on an operation state detection value of the electric oil pump; and means for outputting a control signal corresponding to a determination result of the occurrence of the idling.

* * * * *